United States Patent [19]

Egi et al.

[11] Patent Number: 4,835,525

[45] Date of Patent: May 30, 1989

[54] FLAME MONITORING APPARATUS

[75] Inventors: Hiroshi Egi, Matsudo; Toshiyuki Komori, Tokyo, both of Japan

[73] Assignee: Kabu Shiki Kaisha Toshiba, Kanagawa, Japan

[21] Appl. No.: 130,558

[22] Filed: Dec. 8, 1987

[30] Foreign Application Priority Data

Mar. 31, 1987 [JP] Japan ..... 62-75858

[51] Int. Cl.[4] ..... G08B 17/12; H01L 9/00

[52] U.S. Cl. ..... 340/578; 340/577; 250/554

[58] Field of Search ..... 340/577, 578, 579; 250/554, 338, 350, 351; 98/120, 108; 165/109.1, 59; 219/121 PD

[56] References Cited

U.S. PATENT DOCUMENTS

| | | | |
|---|---|---|---|
| 3,993,900 | 11/1976 | Hulme | 250/554 |
| 4,280,058 | 7/1981 | Tar | 340/578 |
| 4,322,723 | 3/1982 | Chase | 340/578 |
| 4,328,488 | 5/1982 | Yanai et al. | 340/578 |
| 4,381,455 | 4/1983 | Komori | 250/554 |
| 4,464,575 | 8/1984 | Cholin et al. | 340/578 |
| 4,639,605 | 1/1987 | Seki et al. | 340/578 |
| 4,709,155 | 11/1987 | Yamaguchi et al. | 340/578 |

*Primary Examiner*—Joseph A. Orsino
*Assistant Examiner*—Anh H. Tran
*Attorney, Agent, or Firm*—Foley & Lardner, Schwartz, Jeffery, Schwaab, Mack, Blumenthal & Evans

[57] ABSTRACT

An apparatus for monitoring a flame which emits light, the apparatus comprising: (a) a detector for detecting the light and outputting a signal corresponding to the light; (b) a casing for enclosing the detector, the casing including an aperture for the light going to the detector; (c) a blower for supplying air to the casing; and (d) a windmill for periodically shuttering the light to the detector with a shuttering frequency, the windmill being driven by the supplied air.

5 Claims, 3 Drawing Sheets

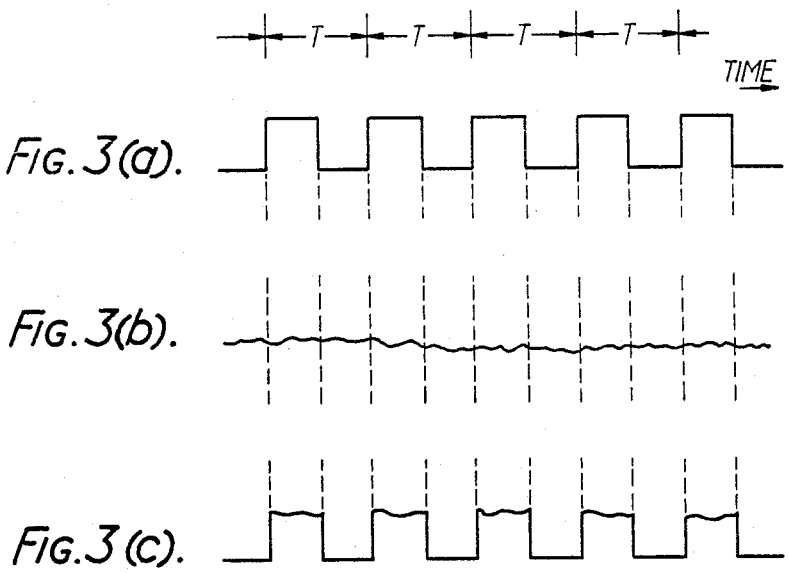
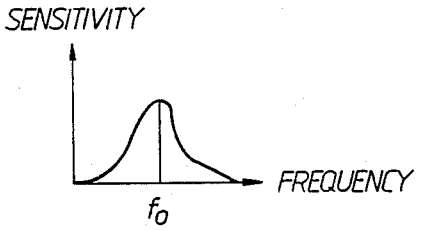
FIG. 4.
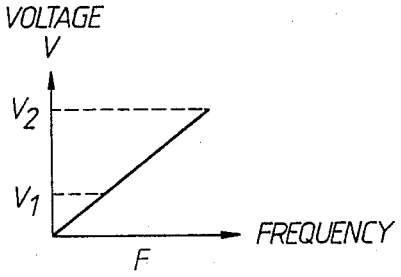
FIG. 5.

FLAME MONITORING APPARATUS

BACKGROUND OF THE INVENTION

1. Field of the Invention

This invention generally relates to an apparatus for monitoring a flame such as a burner flame in a combustion chamber of a boiler, and more particularly, it relates to a monitoring apparatus which is provided with a self-checking function.

2. Description of the Related Art

A monitoring apparatus of this kind is required to be installed in a combustion chamber to give the operator information as to whether the burner is in operation.

U.S. Pat. No. 4,328,488 discloses a flame-monitoring apparatus installed in a combustion chamber. The light emitted from the flame of a particular burner is detected by a light detector in the apparatus, and the status of the burner is monitored.

In order to check if the monitoring apparatus itself is working normally, a periodic shuttering mechanism has been developed. The mechanism shutters periodically the light reaching the detector, and the detected response is compared with the timing or frequency of the shuttering.

This shuttering mechanism may be driven by a reciprocating piston in an air cylinder or by an electromagnetic vibrator. However, the air cylinder requires compressed air and a sophisticated valve mechanism. Furthermore, the reciprocating piston has a problem of friction on its sliding surfaces and the shuttering frequency cannot be sufficiently high. On the other hand, the electromagnetic vibrator requires an electric power source for the electromagnetic coil, and has a problem of heat generation in the coil and of fatigue of the vibrating plate. Therefore, such conventional shuttering mechanisms are not reliable for a sufficiently long time.

SUMMARY OF THE INVENTION

An object of this invention is to provide a flame-monitoring apparatus with a periodic self-checking mechanism which is simple in structure and is also reliable for a long time.

Another object of this invention is to provide a method of flame-monitoring and periodic self-checking of the operation of the monitoring apparatus.

According to the invention, there is provided an apparatus for monitoring a flame which emits light, the apparatus comprising: (a) means for detecting light and outputting a signal corresponding to the light; (b) means for enclosing the detecting means, the enclosing means including an aperture for the light going to the detecting means; (c) means for supplying air to the enclosing means; and (d) means for periodically shuttering the light to the detecting means with a shuttering frequency, the shuttering means being driven by the supplied air.

According to another aspect of the invention there is provided a method of monitoring a light-emitting flame, the method comprising the steps of: detecting the light emitted from the flame with a detector; cooling the detector with flowing air; and periodically shuttering the light to the detector utilizing the flowing air.

Further objects, features and advantages of the present invention will become apparent from the detailed description of the preferred embodiment that follows, when considered with the attached drawings.

BRIEF DESCRIPTION OF THE DRAWINGS

The accompanying drawings, which are incorporated in and constitute a part of this specification, illustrate an embodiment of the invention and together with the description, serve to explain the principles of the invention. In the drawings:

FIG. 3(*a*) is a time chart of the opening of the windmill shown in FIG. 1;

FIG. 3(*b*) is a corresponding time chart of the intensity of the light reaching the windmill shown in FIG. 1;

FIG. 3(*c*) is a corresponding time chart of the current signal of the light detector shown in FIG. 1;

FIG. 4 shows the characteristic curve of the sensitivity versus frequency of the amplifier in the flame judging sub-unit shown in FIG. 1; and FIG. 5 shows the characteristic curve of output voltage versus frequency of the band-pass filter shown in FIG. 1.

DETAILED DESCRIPTION OF THE PREFERRED EMBODIMENTS

Figure 1:
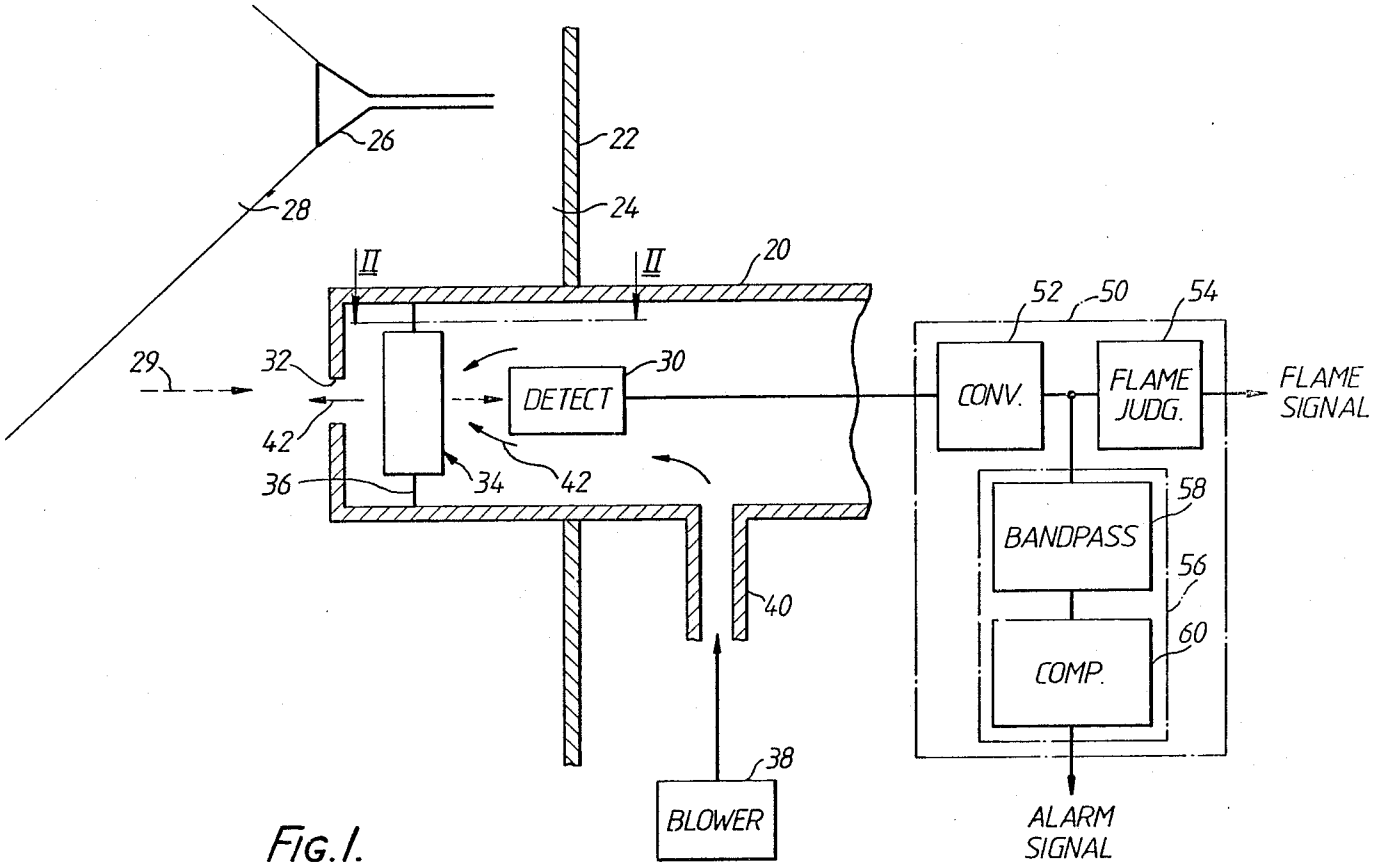
FIG. 1 is a schematic diagram of an embodiment of this invention.

An embodiment of the invention will now be described below, referring to FIG. 1. A cylindrical casing 20 is installed halfway penetrating a wall 22 of a combustion chamber 24. The combustion chamber 24 has a plurality of burners 26 in it. When a burner 26 is in operation, flame 28 is formed. The flame 28 emits light 29, including visible light rays, infrared rays and ultraviolet rays.

A light detector 30 such as a photosensor is enclosed in the casing 20, and an aperture 32 is provided on the casing 20 so that the light 29 emitted from the flame 28 reaches the detector 30 through the aperture 32. The light detector 30 detects the light and converts it into a current signal.

Figure 2A:
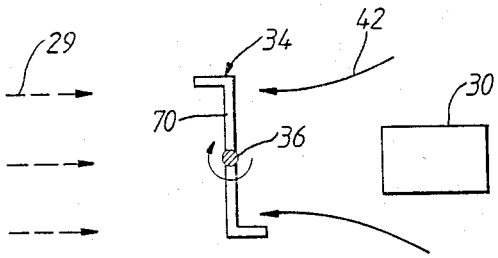
FIGS. 2(*a*) and 2(*b*) are views taken along line II—II of FIG. 1.
Figure 2B:
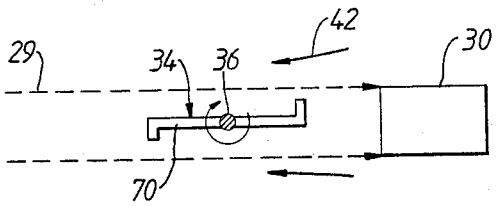

A windmill 34 (shown more clearly in FIGS. 2(*a*) and 2(*b*)) is arranged between the aperture 32 and the detector 30 in the casing 20, so that the light 29 is periodically shuttered when the windmill 34 rotates. The windmill 34 has an axis 36 about which the windmill 34 can rotate.

A blower 38 is provided outside of the casing 20 for supplying air 42 to the casing 20. An exit pipe 40 of the blower 38 is connected to the lower side of the casing 20. The air 42 supplied by the blower 38 to the casing 20 flows around the detector 30, cooling the detector 30, and drives the windmill 34 to rotate, and then exits the casing 20 into the combustion chamber 24 through the aperture 32. Since the air 42 is supplied continuously and the pressure in the casing 20 is maintained constant, the windmill 34 rotates at a constant speed.

FIGS. 2(*a*) and 2(*b*) show how the light to the detector 30 is periodically shuttered by the windmill 34. The windmill 34 comprises a bent plate 70 made of, for example, synthesized resin fixed on the axis 36. The flowing air 42 supplied by the blower 38 to the casing 20 drives the windmill 34 to rotate about the axis 36. When the windmill 34 is in the position shown in FIG. 2(*a*), the light 29 does not reach the detector 30 because of the interference of the plate 70. When the windmill 34 has rotated 90 degrees from the position shown in FIG. 2(*a*), as shown in FIG. 2(*b*), at least part of the light 29 reaches the detector 30.

The intensity of the light 29 which reaches the detector 30 changes periodically as shown in FIG. 3(*c*). The curve shown in FIG. 3(*c*) is the result of a combination of a change of opening through the windmill 34, as shown in FIG. 3(*a*), and the intensity of the light 29 reaching the windmill 34, as shown in FIG. 3(*b*). The opening is closed periodically with a period of T as shown in FIG. 3(*a*). The intensity of the light 29 reaching the windmill 34 fluctuates with a period much shorter than T, as shown in FIG. 3(*b*). The intensity level and its fluctuation amplitudes depend on whether the particular burner 26 which the monitor is monitoring is in operation or not. When the particular burner 26 is out of operation, the intensity level and its fluctuation amplitudes are small, but they are not zero because of the other operating burners in the same combustion chamber 24.

The processing of the signal will now be described. The output current signal from the light detector 30 shown in FIG. 3(*c*) is fed to a judging unit 50, which is arranged outside of the casing 20. The judging unit 50 comprises a signal converter 52, a flame-judging sub-unit 54 and a checking sub-unit 56.

The output current of the light detector 30 is fed to the signal converter 52, and the current is converted to a voltage signal there.

The output voltage of the converter 52 is fed both to the flame-judging sub-unit 54 and to the checking sub-unit 56.

The flame-judging sub-unit 54 extracts the higher frequency component corresponding to the flame fluctuation shown in FIG. 3(*b*) out of the voltage signal from the converter 52. The voltage signal has the same shape as the curve shown in FIG. 3(*c*). The extraction is carried out by an amplifier with band-pass characteristics with a central frequency of $f_0$ as shown in FIG. 4. The central frequency $f_0$ is chosen to be the same as a central frequency of the flame fluctuation. When the amplified output voltage is larger than a stipulated value, the particular burner 26 is judged as being in operation, and the decision is fed to a display device (now shown) as a flame signal.

The checking sub-unit 56 comprises a band-pass filter 58 and a comparator 60. The output of the converter 52 is fed to the band-pass filter 58, and then the output of the band-pass filter 58 is fed to the comparator 60.

In the band-pass filter 58, a pulse signal having a frequency corresponding to the period T, shown in FIG. 3(*a*), is extracted, and the frequency of the extracted pulse signal is transformed to a voltage V, as shown in FIG. 5.

The comparator 60 decides whether the output voltage V from the band-pass filter 58 is appropriate or not. If the voltage V is smaller than a lower limit $V_1$, which means that there is essentially no signal caused by the windmill 34 shuttering, an alarm signal indicating an abnormality in the monitoring apparatus is sent out to the display device (not shown). That indicates that something is wrong with the monitoring apparatus itself. One possibility is that the windmill 34 is stopped, which may be caused by a cessation of the flowing air 42 or a malfunction of the windmill 34 itself. Another possibility is a malfunction of the detector 30 or the judging unit 50.

If the voltage V is larger than an upper limit $V_2$, the detector 30 or the judging unit 50 is determined to be abnormal, and an alarm signal is sent out to the display device.

If the voltage V is between $V_1$ and $V_2$, the monitoring device is judged normal.

Even when the particular burner 26 which this monitoring apparatus is monitoring is not in operation, a small amount of light 29 reaches the detector 30 from the flames of the other burners in the same combustion chamber 24. Consequently, the voltage V becomes larger than $V_1$ if the monitoring apparatus is in normal condition. Therefore, the normality of the monitoring apparatus is checked regardless of the status of the burner 26.

In this embodiment, the normal operation of the monitoring apparatus can be periodically checked for a long time.

The foregoing description has been set forth merely to illustrate a preferred embodiment of the invention and is not intended to be limiting. Since modifications of the described embodiment incorporating the spirit and substance of the invention may occur to persons skilled in the art, the scope of the invention should be limited solely with respect to the appended claims and equivalents.

What is claimed is:

1. An apparatus for monitoring a flame which emits light, the apparatus comprising:

(a) means for detecting the light and outputting a signal corresponding to the light;

(b) means for enclosing the detecting means, the enclosing means including an aperture for the light going to the detecting means;

(c) means for supplying cooling air to the enclosing means to cool said detecting means; and (d) means for periodically shuttering the light to the detecting means with a shuttering frequency, the shuttering means being driven by the supplied cooling air, wherein the shuttering means comprises a windmill rotatably installed in the enclosing means.

2. An apparatus according to claim 1, wherein the enclosing means is so constructed that the supplied air exits the aperture.

3. An apparatus according to claim 1, further comprising:

(a) means for deciding whether the flame exists or not, based on an intensity of said signal;

(b) means for checking that said signal includes a sufficient component of said shuttering frequency.

4. An apparatus for monitoring a flame which emits light, the apparatus comprising:

(a) means for detecting the light and outputting a signal corresponding to the light;

(b) means for enclosing the detecting means, the enclosing means including an aperture for the light going to the detecting means;

(c) means for supplying cooling air to the enclosing means to cool said detecting means; and (d) means for periodically shuttering the light to the detecting means with a shuttering frequency, the shuttering means being driven by the supplied cooling air;

(e) means for deciding whether the flame exist or not, based on an intensity of said signal; and (f) means of checking whether said light is periodically shuttered with said shuttering frequency by checking said signal.

5. An apparatus according to claim 4, wherein said means for checking comprises a band-pass filter with a central frequency of said shuttering frequency.

* * * * *